US006536969B2

(12) United States Patent
Nishitani

(10) Patent No.: US 6,536,969 B2
(45) Date of Patent: Mar. 25, 2003

(54) WRITING TOOL EQUIPPED WITH INK RESERVOIR

(75) Inventor: Ichiro Nishitani, Yamatokoriyama (JP)

(73) Assignee: Kuretake Co., Ltd., Nara (JP)

( * ) Notice: Subject to any disclaimer, the term of this patent is extended or adjusted under 35 U.S.C. 154(b) by 0 days.

(21) Appl. No.: 10/052,965

(22) Filed: Jan. 18, 2002

(65) Prior Publication Data

US 2002/0110403 A1 Aug. 15, 2002

(30) Foreign Application Priority Data

Jan. 18, 2001 (JP) ..... 2001-010284

(51) Int. Cl.[7] ..... A46B 11/00; B05C 11/10; B43K 5/02; B43K 5/18; B43K 7/10

(52) U.S. Cl. ..... 401/4; 401/187; 401/188 A; 401/206; 401/219; 401/274; 401/278; 401/286

(58) Field of Search ..... 401/4, 187, 188 A, 401/198, 205, 206, 214, 219, 270, 274, 275, 278, 282, 286

(56) References Cited

U.S. PATENT DOCUMENTS 5,073,058 A * 12/1991 Fukuoka et al. ..... 401/206
5,468,082 A * 11/1995 Hori ..... 401/188 A
6,176,632 B1 * 1/2001 Kageyama et al. ..... 401/286

FOREIGN PATENT DOCUMENTS

| | | | |
|---|---|---|---|
| JP | 57-6578 | 6/1982 | |
| JP | 57-198769 | * 6/1982 | ..... 401/206 |
| JP | 6-59091 | 8/1994 | |

OTHER PUBLICATIONS

Dec. 17, 2002 Japanese–language official action (and English–language translation thereof) in counterpart Japanese patent application No. 2001–010284.

* cited by examiner

*Primary Examiner*—Gregory Huson
*Assistant Examiner*—Tuan Nguyen
(74) *Attorney, Agent, or Firm*—John P. White; Cooper & Dunham LLP

(57) ABSTRACT

A writing tool is provided. An ink reservoir (7) and an ink supply passage (9) are formed in a barrel (1) provided with a brush body (2). Ink contained in the ink reservoir (7) is supplied to the brush body (2) via the ink supply passage (9). A wire (17) movably provided in the ink supply passage (9) is movably supported by a coiled spring (16). A ball (18) is provided in the ink reservoir (7). While the barrel (1) is being moved, the ball (18) collides with the coiled spring (16), thereby moving the wire (17).

9 Claims, 2 Drawing Sheets

WRITING TOOL EQUIPPED WITH INK RESERVOIR

CROSS-REFERENCE TO RELATED APPLICATION

This application is based upon and claims the benefit of priority from the prior Japanese Patent Application No. 2001-010284 filed Jan. 18, 2001, the entire contents of which are incorporated herein by reference.

BACKGROUND OF THE INVENTION

The present invention relates to a writing tool with an ink reservoir such as a writing brush or a ballpoint pen, etc., and more particularly to a writing tool in which ink in the ink reservoir is supplied to the nib of the tool.

In some writing brushes, an ink reservoir is defined in the trunk so that ink is supplied to the nib through the ink supply passage. In these writing brushes, the nib is covered with a cap when not used so that ink in the nib will not be hardened.

However, even if the nib is covered with a cap, the nib may dry up if the writing brush is not used for a long time. Further, if the writing brush is not used for a long time, the ink supply passage may clog up even if the nib is kept moist. Accordingly, ink does not easily come out and hence ease of writing cannot be obtained.

Such a phenomenon often occurs when a writing brush is not used for a long time, even if the cap is placed on the brush. This may cause a user to think that most available writing brushes cannot be kept for a long time.

The inventor of the present invention has paid attention to this phenomenon, reviewed its cause and found that the phenomenon occurs for the following reason: Ink to be used includes ink containing a dyestuff and ink containing an insoluble coloring pigment. When using, in particular, ink containing an insoluble coloring pigment, if a writing brush is not used for a long time, pigment particles contained in the ink may easily deposit and coagulate between the strands of the brush or the narrow ink supply passage leading to the strands. It was found that such agglomerated powder would clog the ink supply passage or interrupt the capillary action of the strands, which makes it difficult for ink to come out and hence degrades ease of writing.

Moreover, since the pigment actually used contains not only uniform particles of a small diameter but also particles of larger diameters, it will easily agglutinate. In addition, ink containing a high-density pigment is now used very frequently, which increases the possibility of clogging.

Also in the case of using ink containing a dyestuff, when a writing brush is not used for a long time, the dyestuff, for example, may crystallize, thereby interrupting the supply of ink and hence degrading the writing performance of the pen.

BRIEF SUMMARY OF THE INVENTION

It is the object of the present invention to provide a writing tool capable of easily eliminating the clogging of ink to thereby restore and maintain ease of writing.

A writing tool according to the present invention comprising:

a writing tool body;

a nib attached to a front end of the writing tool body;

an ink reservoir formed in the writing tool body and containing ink;

an ink supply passage formed in the writing tool body and configured to supply ink contained in the ink reservoir to the nib;

a wire member movably provided in the ink supply passage;

a spring member provided in the writing tool body and supporting the wire member such that the wire member can move; and a movable body movably provided in the writing tool body, the movable body moving the wire member while the writing tool body is being moved.

The present invention can provide a writing tool capable of easily eliminating the clogging of ink, thereby restoring and maintaining ease of writing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1A:
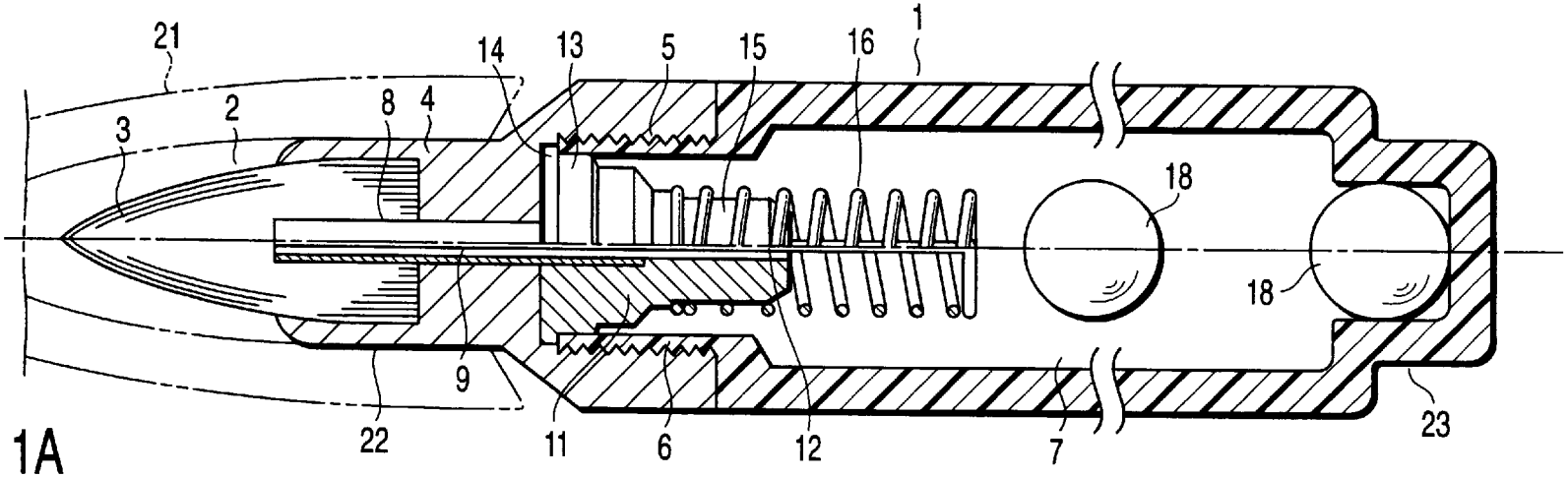
FIGS. 1A and 1B are longitudinal sectional views illustrating a writing tool of a brush type according to a first embodiment of the invention.
Figure 1B:
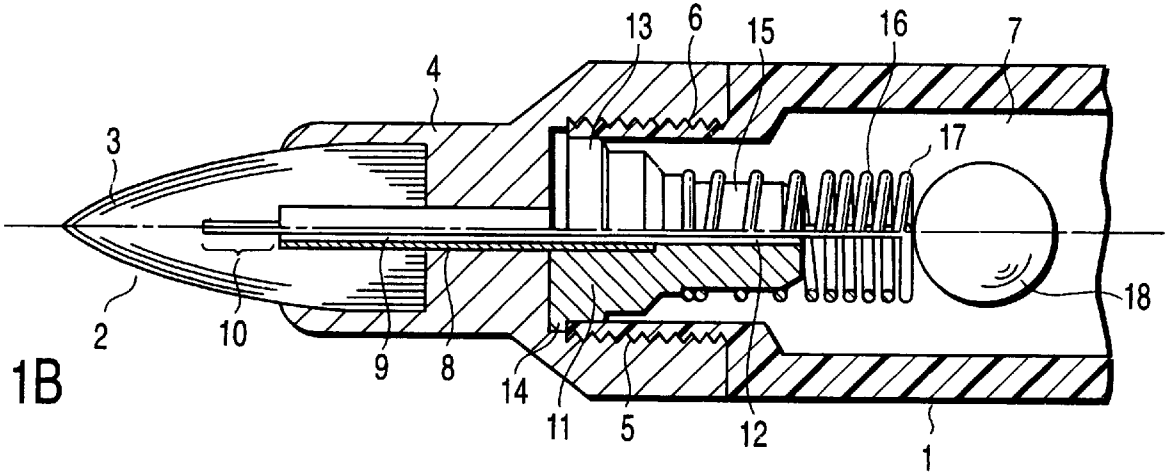

Referring to FIGS. 1A and 1B, a description will be given of a writing tool of a brush type according to a first embodiment of the invention.

In FIGS. 1A and 1B, reference numeral 1 denotes a barrel as a writing tool main body. The barrel 1 is also a pen tube. A brush body 2 is provided as a nib on the front end of the barrel 1. The brush body 2 is a bundle of a number of strands, and a brush 3 is tapered. The waist portion of the brush 3 is fixed to the shaft of a head 4. A small-diameter portion 6 with a screw portion 5 is provided at the outer periphery of a front end portion of the barrel 1. The proximal end of the head 4 is screwed on the small-diameter portion 6.

Substantially the entire interior of the barrel 1 defines an ink reservoir 7, which holds ink containing an insoluble pigment.

A pipe 8 is inserted through the head 4 along its axis. The pipe 8 forms a part of the front stage of an ink supply passage 9 for guiding ink from the ink reservoir 7 to the brush 3 of the brush body 2. The front end of the pipe 8 is located in a central portion 10 of the brush 3 extending between the waist and bust of the brush 3 of the brush body 2. The central portion 10 of the brush serves as a front area for distributing ink to the entire brush 3 of the brush body 2, and forms the front-stage of the ink supply passage 9.

Further, a proximal portion of the pipe 8 protrudes into the barrel 1. A front end portion of a support member 11 is fitted in a front end wall of the barrel 1. A rear-end portion of the pipe 8 is inserted in a hole 12 formed in the support member 11. The hole 12 and pipe 8 form the rear-stage of the ink supply passage 9.

A front end portion 13 of the support member 11 has a diameter which enables the portion to be tightly fitted on the inner surface of a front end portion of the barrel 1. A collar 14 is formed at the front end of the support member 11. The collar 14 is held between the barrel 1 and the head 4 when the head 4 is screwed in the front end portion of the barrel 1.

A rear end portion 15 of the support member 11 is formed relatively thinner than the front end portion thereof, and a front end portion of a spring member as an elastic member, i.e. a coiled spring 16 in this case, is fitted on and secured to the rear end portion 15. The coiled spring 16 has a rear end portion projecting from the rear end of the support member 11 and serving as a free end positioned in the internal space of the ink reservoir 7 defined in the barrel 1. In other words, the coiled spring 16 as a spring member has one end supported by the support member 11 and the other end floating in the ink reservoir 7 of the barrel 1.

A wire 17, which is formed of the spring material of the coiled spring 16, has one end extending from the rear end of the coiled spring 16 to a position immediately before the front end of the pipe 8 through the center of the coiled spring 16, the hole 12 of the support member 11 and the interior of the pipe 8. The wire 17 extends from the rear end of the coiled spring 16, is inserted through the ink supply passage 9 of the pipe 8, and has its front end positioned immediately before the front end of the pipe 8.

However, as shown in FIG. 1B, when the coiled spring 16 contracts, the wire 17 advances, whereby its front end protrudes from the front end of the pipe 8 into the brush 3 of the brush body 2 and reaches the central portion 10 of the brush.

The ink reservoir 7 of the barrel 1 contains, for example, a metal ball 18, which has a specific gravity greater than ink and serves as a moving body movable with respect to the barrel 1. In this case, as shown in FIG. 1A, two balls 18 are contained such that they can move in the barrel 1.

In this embodiment, since both the two balls 18 are spherical and each have a diameter not less than the radius of the ink reservoir 7 of the barrel 1, the front-side ball is not positioned behind the rear-side ball, or vice versa, in the ink reservoir 7. Thus, the positional relationship of the two balls 18 in the back-and-forth direction is fixed. The diameter of each ball 18 is larger than the difference between the diameter of the ink reservoir 7 and that of the coiled spring 16. The diameter of each ball 18 is larger than that of the coiled spring 16.

Each ball 18 can move in the barrel 1 forwardly and backwardly, using the gravity and inertia. When the balls 18 move backwardly and forwardly in the barrel 1, they collide with each other, and the front-side ball 18 collides with the rear end of the coiled spring 16. The ball 18 does not enter a lateral space defined along the coiled spring 16.

When the writing tool is not used, a cap 21 for covering the brush body 2 can be mounted on the outer periphery 22 of the head 4. A mounting section 23 is provided at the rear end of the barrel 1 for mounting thereon the cap 21 when the writing tool is not used.

A description will now be given of the operation of the brush-type writing tool according to the embodiment, executed when it is used as a writing brush. First, the cap 21 is detached to expose the brush body 2 and make it usable. When ink is used at the brush body 2, ink contained in the ink reservoir 7 is continuously supplied to the brush body 2 through the ink supply passage 9 in accordance with the amount of use, thereby enabling the writing brush to be used continuously.

When the brush-type writing tool is not used, the brush body 2 is covered with the cap 21 so that ink will not coagulate, thereby preventing the brush body from drying up. Accordingly, when using the tool again, it is sufficient if the cap 21 is detached from the tool.

However, in the case of using the tool after a long period of disuse, it was possible that ink would not be sufficiently supplied to the brush body to thereby degrade ease of writing, not only when the brush body was dried up, but also when the brush body was moist. This phenomenon will easily occur, in particular, when the tool is left unused for a long time. Further, this phenomenon may occur even if the writing tool is stored with the cap 21 mounted thereon. This is because, as aforementioned, pigment particles contained in the ink easily deposits and coagulates to thereby clog up the narrow ink supply passage in the brush or to interrupt the capillary action of the brush.

If the flow of ink is interrupted or the supply of ink to the brush body is insufficient, the following operation is executed. The barrel 1 is gripped and shaken, thereby moving the balls 18 under their own inertia and colliding one of the balls 18 with the rear end of the coiled spring 16. At this time, the coiled spring 16 is contracted by the pushing force of the ball 18. The wire 17 advances as shown in FIG. 1B, and the tip of the wire 17 enters the brush. As a result, the tip of the wire 17 crumbles the pigment particles deposited and coagulated in the brush, thereby eliminating the coagulated state. When the ball 18 collides with the coiled spring 16, horizontal and vertical vibration occurs in the coiled spring 16, as well as the contraction of the spring 16. Accordingly, the tip of the wire 17 moves in a complicated manner to thereby efficiently crumble the coagulated particles. Thus, the smooth flow of the ink resumes, thereby restoring ease of writing.

As shown in FIG. 1B, when the tip of the wire 17 assumes its foremost position, the coiled spring 16 is most contracted. At this time, the resilience of the coiled spring 16 is strongest, while the shock applied to the brush body is small. Accordingly, the wire 17 does not excessively stimulate the brush body. Furthermore, since the wire 17 is inserted in a slim guide extending through the relatively long pipe 8 and the central hole 12 of the support member 11, it does not extremely move and hence does not damage the brush 3 of the writing tool.

Also while the tool is being used usually, the balls 18 move in accordance with the movement of the barrel 1, whereby the tip of the wire 17 is forwarded when one of the balls 18 collides with the rear end of the coiled spring 16. The deposited pigment is always prevented from accumulating in the brush, thereby maintaining ease of writing.

Figure 2A:
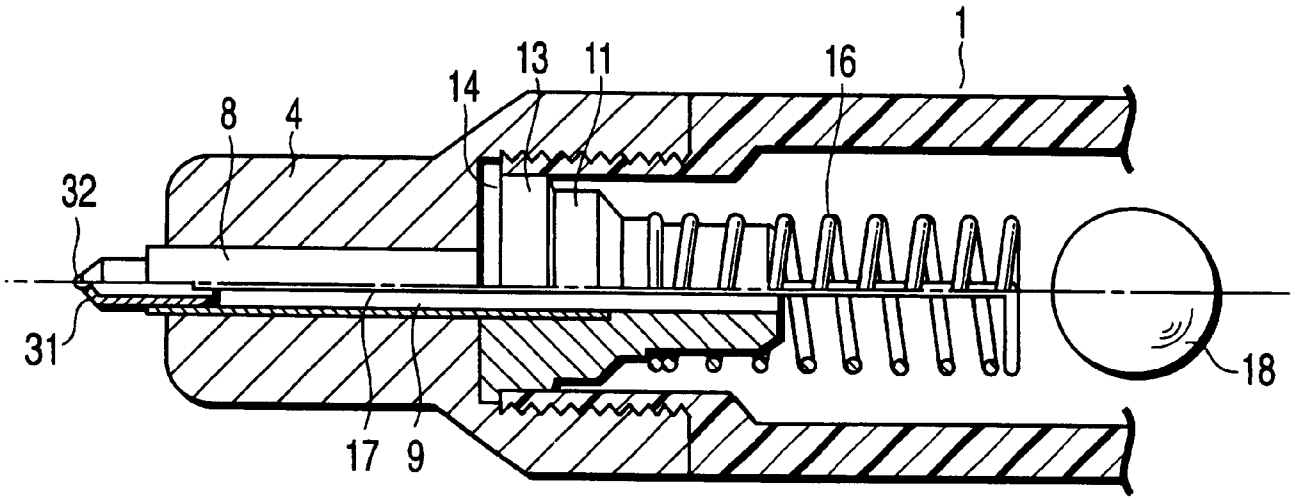
FIGS. 2A and 2B are longitudinal sectional views illustrating a writing tool of a ballpoint pen type according to a first embodiment of the invention.
Figure 2B:
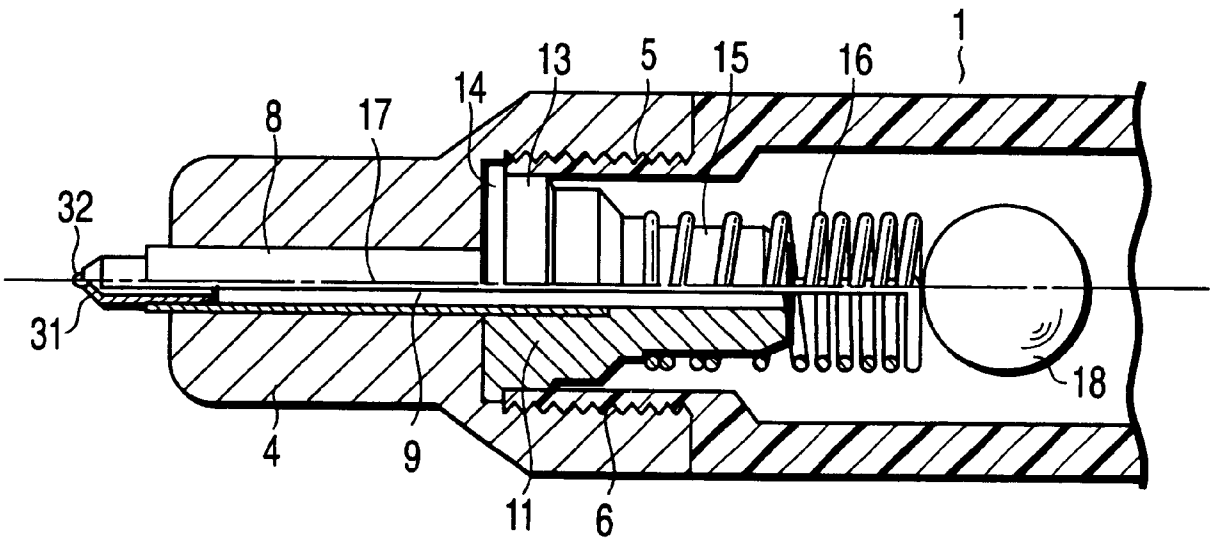

Referring now to FIGS. 2A and 2B, a writing tool of a ballpoint pen type according to a second embodiment of the invention will be described. The writing tool of this embodiment differs from the above-described first embodiment in that in the former, the nib of the writing tool is of a ballpoint pen type. The other structure of the second embodiment is similar to that of the first embodiment.

At the tip of this writing tool, a ball housing 31 is provided at the front end of the head 4, and a ball 32 is rotatably fitted in the ball housing 31. An ink supply passage 9 communicates with the ball housing 31. The tip of a wire 17, which is led from the rear end of the coiled spring 16, enters the ball housing 31 and reaches a position immediately before the ball 32.

Also in the second embodiment, the wire 17 can prevent the ink supply passage 9 from clogging up when the writing tool is usually used, as well as when pigment contained in ink deposits and coagulates to clog up the ink supply passage 9 and cause insufficient flow of ink, after the writing tool is not used for a long time. As a result, ease of writing can be maintained.

Although in the above embodiment, the ball 32 as a movable body, which moves when the barrel 1 is shaken, is movably provided in the barrel 1 such that it can move separately from the coiled spring 16, the movable body may be connected to the rear end of the coiled spring 16. In this case, the movement of the movable body is transmitted to the wire 17 via the coiled spring 16, thereby moving the wire 17 to prevent the accumulation of a pigment deposit. Since the ball 32 is not collided with the coiled spring 16 but is moved together with it, it applies a relatively small shock to the nib and accordingly does not excessively stimulate it.

Although the above-described embodiments are directed to a brush type and a ballpoint pen type, the present invention can be also applied to another type of writing tool such as a felt pen or a correction ink pen, etc. In addition, the ink used may contain a dyestuff.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A writing tool comprising:

a writing tool body;

a nib attached to a front end of the writing tool body;

an ink reservoir formed in the writing tool body and containing ink;

an ink supply passage formed in the writing tool body and configured to supply ink contained in the ink reservoir to the nib;

a wire member movably provided in the ink supply passage;

a spring member provided in the writing tool body, the spring member having one end supporting the wire member, and another end supported by the writing tool body; and a movable body movably provided in the writing tool body, the movable body being collided with the one end of the spring member that supports the wire member, thereby transmitting a movement to the spring member to thereby move the wire member.

2. The writing tool according to claim 1, wherein the nib has a brush formed of a bundle of strands.

3. The writing tool according to claim 1, wherein the nib is a writing ball.

4. The writing tool according to claim 1, wherein the movable body having a spherical ball.

5. The writing tool according to claim 4, wherein the ball has a diameter larger than a difference between a diameter of the ink reservoir and a diameter of the coil spring.

6. The writing tool according to claim 1, wherein the movable body has a diameter larger than a radius of the ink reservoir.

7. The writing tool according to claim 6, wherein there are provided two movable bodies.

8. The writing tool according to claim 1, wherein the ink supply passage is defined by an inner hole of a pipe, and the wire member moves in the pipe, using the pipe as a guide.

9. The writing tool according to claim 1, wherein the spring member is a coiled spring.

* * * * *